US005474489A

United States Patent [19]

Vernon

[11] Patent Number: 5,474,489

[45] Date of Patent: Dec. 12, 1995

[54] LENS BLOCKING AND CONSTANT CENTER THICKNESS SYSTEM

[75] Inventor: Edward W. Vernon, Santa Barbara, Calif.

[73] Assignee: D.A.C., Inc., Carpinteria, Calif.

[21] Appl. No.: 185,790

[22] PCT Filed: Oct. 20, 1993

[86] PCT No.: PCT/US93/10011

§ 371 Date: Jan. 24, 1994

§ 102(e) Date: Jan. 24, 1994

[87] PCT Pub. No.: WO94/09946

PCT Pub. Date: May 11, 1994

Related U.S. Application Data

[63] Continuation-in-part of Ser. No. 676,762, Mar. 27, 1991, Pat. No. 5,205,076, and Ser. No. 966,140, Oct. 26, 1992, abandoned.

[51] Int. Cl.[6] ..... B24B 1/00

[52] U.S. Cl. ..... 451/42; 451/390

[58] Field of Search ..... 451/42, 255, 256; 409/313, 315

[56] References Cited

U.S. PATENT DOCUMENTS

| | | | |
|---|---|---|---|
| 4,237,912 | 12/1980 | Nefe | 451/42 |
| 4,619,082 | 10/1986 | Deuf et al. | 451/390 |
| 4,653,234 | 3/1987 | Lombard | 451/390 |
| 4,856,234 | 8/1989 | Goins | 451/390 |
| 5,291,692 | 3/1994 | Takahashi et al. | 451/390 |

FOREIGN PATENT DOCUMENTS

| | | | |
|---|---|---|---|
| 4003002 | 5/1991 | Germany . | |
| 148150 | 7/1987 | Japan | 451/390 |

*Primary Examiner*—Maurina T. Rachuba
*Attorney, Agent, or Firm*—Marvin E. Jacobs

[57] ABSTRACT

A base lens blocking system comprises a blocking member formed of a flange with a rearward directed shank received in a collet of a spindle, preferably, a dead length, recessed collet. The front surface of the flange contains a lens blank engaging region which can be recessed. The lens blank is applied to the flat, front surface of the flange by means of a disc of adhesive tape, either a thermoplastic adhesive or a double-sided pressure sensitive adhesive tape or a very thin film of wax applied to a heated surface of the flange under a pressure from 5–20 pounds. A batch of blocked lens blanks can be cut with base curves and processed to finished lenses without measuring the center thickness of the base curves of each lens.

20 Claims, 2 Drawing Sheets

LENS BLOCKING AND CONSTANT CENTER THICKNESS SYSTEM

CROSS REFERENCE TO RELATED APPLICATION

This application is a continuation-in-part of our U.S. application Ser. No. 07/676,762, filed Mar. 27, 1991, now U.S. Pat. No. 5,205,076, issued Apr. 27, 1993, and U.S. application Ser. No. 07/966,140, filed Oct. 26, 1992, now abandoned.

BACKGROUND OF THE INVENTION

This invention relates to the formation of contact and intraocular lenses, and more particularly to lens manufacture with computer controlled machine tools.

For many years, contact lens base curves have been generated by lathing a plastic lens blank while it is grasped in a standard drawback collet. Although this system has proven to be satisfactory in the past and has been used to provide millions of base curves for contact lenses, there are a number of problems that arise from this operation. Even if the button diameter is held to a very tight and repeatable tolerance, interferometer studies show that the base curve is discernibly distorted by the grasp of the collet. The tighter the grasp of the collet, the more distortion. Distortion can be minimized by reducing the grasp of the collet. However, going too far in this direction can cause the button to slip and as a result, an expensive diamond tool can be ruined. As lathing equipment improves and more accurate base curves are produced by the lathing operation, less polishing is required and generally, better optics are produced (less distortion), if polishing is kept to a minimum.

In order to avoid the distortion produced by having the lens blank in a collet, a number of base curve blocking systems have been developed by a variety of manufacturers of contact lenses in which the blank is adhered to the block with a thick film of wax adhesive. Generally the contour of the lens produced from blocked base curves is more accurate and has less distortion than base curves generated directly in drawback collets.

However, the use of thick film wax adhesives to block lens blanks before cutting base curves is not conducive to cutting a series of lenses with constant center thickness. The wax is usually applied as a thick film onto the surface of a blocking member and the lens blank applied to this thick film with pressure which varies from blank to blank. Another type of prior at base curve blocking member had a cavity on the surface of the block that was filed with hot wax. As the wax cooled, it contracted and pulled the lens blank into the cavity deforming the blank and distorting its shape during cutting of the base curve. When the lens blank with base curve was removed from the surface of the blocking member, the force is released. The lens blank returns to its original shape which changes the shape of the base curve.

Several manufacturers produce a constant center thickness base curve (and this is always an additional operation) to eliminate the necessity of measuring center thickness (a difficult operation that is subject to error) before mounting the base curve blank on a block for front surface cutting.

Statement of the Invention

The present invention seeks to significantly reduce the possibility of error in mounting lens blank to a block for generation of the base curve surface or outer lens surface, to eliminate the need for center thickness measurement prior to blocking, and to shorten the overall manufacturing process.

These goals are accomplished by the combination of a new technique for locating the posterior surface of the lens blank, special blocking members that automatically establish the distance to the lens posterior surface when the lens blank is mounted, and a modified spindle/collet construction that precisely aligns the blocking member (and thus the lens blank) to the spindle.

The base curve blocking member includes a flange with a rearward facing surface that is spaced a precisely known distance from its forward alignment surface. The spindle collet can be modified so that it is recessed into the interior of the spindle, whereby the rearward facing flange surface abuts directly against the forward end of the spindle when the blocking member is in place. Since the lens blank is held with its posterior surface at a precisely known location relative to the blocking member, and the blocking member is held at a precisely know position relative to the spindle, the position of the posterior lens surface relative to the spindle is also precisely known without the need to measure the lens blank thickness. Thus, computer controlled formation of the outer lens surface can proceed without the extraneous data entry requirements of past procedures.

This invention also provides a system for the blocking of lens blank permitting generation of the base curve profile and a constant center thickness in a single operation. The button can be mounted on a flat surface of a base curve lens block parallel to the reference surface by means of a strip of adhesive or the block can be provided with a recess accurately made relative to the rearward facing surface of the flange. In a single setup, an error free base curve can be generated and a known center thickness produced. The subsequent operations are more simple and more cost effective.

Another aspect of the invention relates to a procedure which uses a very thin film of wax adhesive to provide lenses with constant center thickness base curves. In accordance with the invention, the flat, polished surface of a base curve lens blocking member is heated to a temperature above the melting temperature of the wax adhesive, usually from 80° F. to 150° F., generally about 110° F. to 135° F. A film of wax is applied to the surface. A flat surface of the lens blank is placed in contact with the warm film of wax under pressure sufficient to squeeze most of the wax from under the lens blank out onto the surrounding surface of the blocking member to form a very thin film of wax adhesive having virtually zero thickness. The pressure is maintained until the thin film sets and bonds the lens blank to the surface. The pressure applied to the lens blank is usually a controlled uniform pressure in the range from 5 to 20 pounds, generally about 10 pounds for 1 to 20 minutes.

Surprisingly, the thin film of wax adhesive is found to be stronger than thicker films. The thinness of the adhesive also assures that the lens blank is mounted perpendicular to the axis of the blocking member and concentric with the axis of the blocking member with a high degree of accuracy. The use of a very thin film of wax adhesive formed under pressure results in reliably cutting a plurality of parts with base curves with constant center thickness.

The separate measurement of center thickness of each lens on an interferometer or other instrument is avoided. A batch of lens blanks can be automatically cut with base curves and then processed to finished lenses without measuring center thickness.

When using a drawback collet to hold the block, the flange of the base curve block must be probed for position. It is possible to generate a base curve with a known dimension relative to the mounting surface of the block. When employing a dead length collet system, a single probing operation is all that is necessary (providing that the blocks are accurately made) for a complete run of base curves. Tests indicate that by very careful blocking, base curve center thickness can be held within ±2 microns. Certainly, a ±5 micron center thickness variation for a large lot of lenses is quite simple to attain by this system.

A base curve with a constant center thickness, mounting ledge, edge lift and the beginning of the lens edge contour can be produced in a single operation. As the sag of the lens is known exactly in relationship to the ledge on the base curve button, it is now possible to mount the base curve button on a proper block for front surface cutting and to proceed with the generation of the front surface without measuring center thickness. Base curve blocking gives the advantages of more accurate base curves with less distortion, a constant center thickness for cost savings and downstream processing. Further, by utilizing the blocking ledge detail the product is prepared for accurate front curve blocking.

Many systems have evolved for the blocking of contact lens base curve lens blanks in preparation for the cutting of the front surface. All of the systems are based on using some sort of heated wax-like adhesive and applying the lens blank to the block with the wax being used as a bond. Systems that utilize wax only, allow for flexure of the lens during the final cut and this, of course, results in a lens that is optically distorted.

Alignment has been done, in some cases, by spinning the block about its center and aligning the button to the block by a probe which controls the button (runout). Other systems depend on bringing the lens blank and block together in some sort of fixture that has been pre-aligned to insure that the centerline of the lens blank is coincident with the centerline of the block.

As the lathing process has progressed, pre-cutting of at least a portion of the lens edge, makes it mandatory to improve the runout and wobble of the lens blank in relationship to the block.

In the past, hand finishing operations could hide the result of blocking errors (thick and thin edges) by hand blending processes. As the procedure for making contact lenses becomes more automated and more complete, the requirements for accurate blocking dramatically increase.

A lens blank with base curve and a surrounding ledge self-aligns when placed in a front curve mounting block with a complementary surface eliminating wobble and providing concentric mounting of the lens blank is disclosed in our prior U.S. Pat. No. 5,205,076.

The block receives the mounting adhesive and the lens blank with base curve and mounting edge and automatically provides for wobble free, concentric alignment of the lens blank to the block.

The improved front curve blocking system uses a minimal amount of wax. The base curve is supported, below the wax layer, with a portion of the block made to approximately the same radius as the base curve. This provides proper support during the final cutting of the front curve.

With the front curve blocking system, it is possible to hold the runout of the button to less than 20 microns TIR. The front curve block may also be provided with a flange that aligns and directs the front curve block and base curve in reference to the spindle. A series of lenses with the same center thickness can be cut after a single probe to locate the reference surface on the lens blank.

The base curve blocking member of the present invention may be utilized while forming a reference surface in the lens blank at the same time the base curve posterior surface is formed, as disclosed in our prior U.S. Pat. No. 5,205,076. The reference surface can be utilized to automatically align the lens blank with the blocking member and spindle for creation of the outer lens curve. To accomplish this, the position of the reference surface is accurately fixed with respect to the posterior surface, and the spindle/blocking mechanism can be modified so that the position of the blocking member relative to the spindle is accurately known. This combination results in an automatic alignment of the lens blank and spindle prior to the formation of the outer lens curve, eliminating the need to measure the lens blank after the posterior surface has been formed, and without having to enter additional data regarding the position and thickness of the lens blank into the computer control for the lathe system. The automatic alignment capability at the same time substantially eliminates discrepancies in both prism and wobble, setting these factors either at zero or at a desired finite value.

These and many other features and attendant advantages of the invention will become apparent as the invention becomes better understood by reference to the following detailed description when considered in conjunction with the accompanying drawings.

DETAILED DESCRIPTION OF THE INVENTION

The invention will be described in detail in connection with a contact lens having a concave base curve for its posterior surface, although it is equally applicable to intraocular lenses having concave, flat or convex posterior surfaces. The base curve and reference surface can be generated with a conventional com- puter-controlled lathe system.

Figure 1:
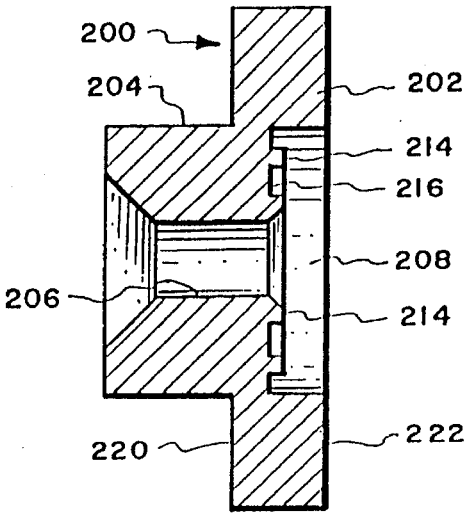
FIG. 1 is a view in section of a first embodiment of a base curve block in accordance with the invention.
Figure 2:
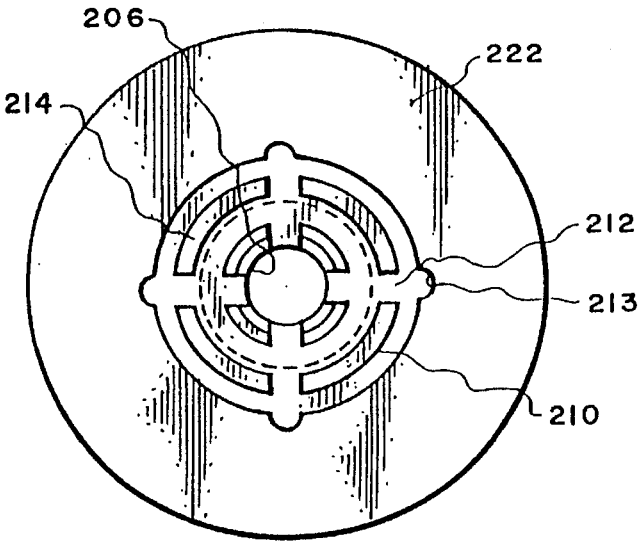
FIG. 2 is a front view in elevation of the base curve block shown in FIG. 1.

A first embodiment of a block 200 for mounting the lens button for forming a base curve is illustrated in FIGS. 1 and 2. The block 200 has a front flange member 202 connected to a rearward shank 204, having a hollow axial shaft 206. An axial recess 208 is formed in the front face of the block 200. The recess 208 is sized to receive a lens blank, not shown.

The lower face of the recess 208 contains circular grooves 210 and radial groves 212 forming a cavity for receiving a film of adhesive such as hot wax adhesive or an ambient temperature curable adhesive. The top edges 214 of the lands 216 remaining after machining the grooves act as a lens block receiving reference surface. The radial grooves 212 may extend past the outer diameter of the lens button to form runoff cups 213 for excess adhesive.

The rear surface 220 of the flange 202 and the front surface 222 of the flange are both orthogonal to the axis of the block 200 and are both parallel to the reference surface 214. The position of the rear surface 220 can be used to locate the reference surface 214 and to program the depth of cut of the lathe when using a dead end spindle. The front surface 222 can be used to probe and locate the position of the reference surface when using a standard drawback collet.

The base curve block 200 can be formed of metal and the front and reference surfaces of the flange can be precisely machined. The use of the block eliminates the errors in thickness by directly grasping the plastic button in a collet. However, the diameter and height of the bottom of the lens button can vary. If the diameter is less than the recess the bottom may not be concentrically located and if the diameter is larger than the recess, the button will be distorted. Another embodiment of a base curve blocking assembly that is not affected by variations in the size of the lens button is illustrated in FIGS. 3–6.

The block 300 can be metal or plastic, preferably metal. The block 300 has a front flange member 302 connected to a rearward shank 304. The flange has a front reference surface 322 and a rear surface 320. The block 300 does not have a recess. A lens blank 310 is centered by external tooling, not shown. The lens blank is attached to the front reference surface with a thin tape 330 of adhesive, preferably precut to coincide with the bottom surface of the lens blank. The adhesive tape is solid at room temperature and has higher tensile strength and melting point than the waxes conventionally used for this purpose. The seating surface 320 and the flange are in a single plane. The front reference surface 322 may be probed to allow the lens blank 310 to be cut with a concave surface and produce a series of parts with a constant center thickness.

Figure 3:
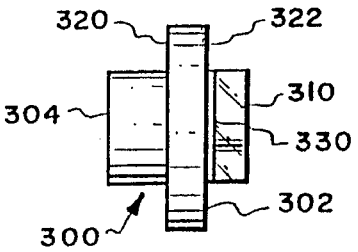
FIG. 3 is a side view in elevation of another embodiment of a base curve block shown assembled with a layer of adhesive and a lens blank.
Figure 4:
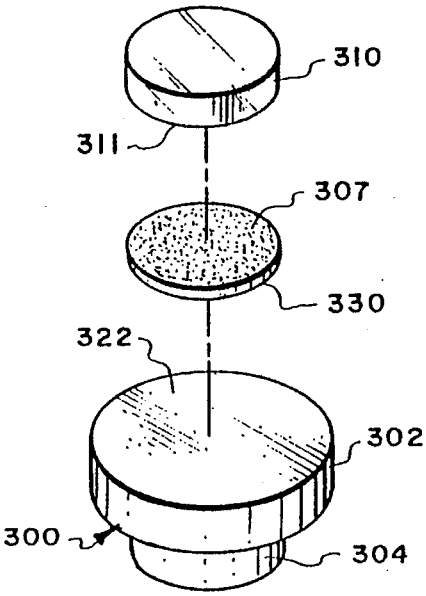
FIG. 4 is an exploded view in perspective of the assembly shown in FIG. 3.
Figure 5:
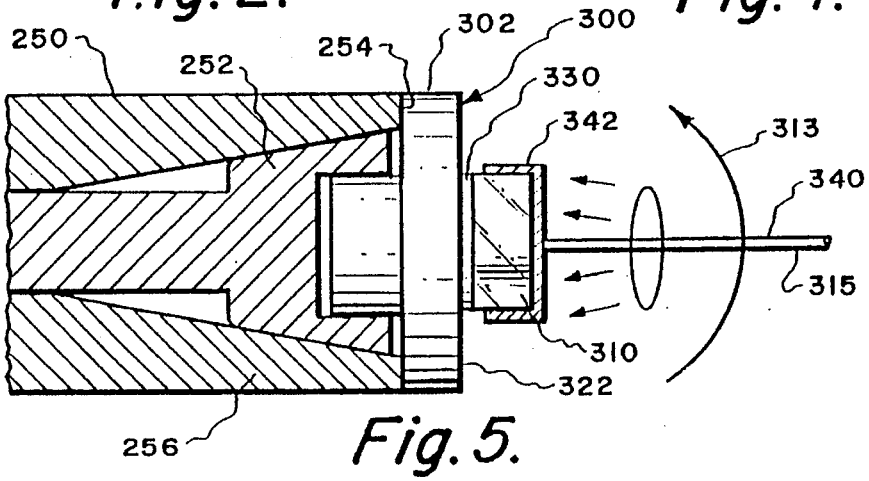
FIG. 5 is a schematic view of the application of heat and pressure to the assembly of FIG. 3 while received in a spindle of a lathe.

Referring now to FIGS. 3–5, the sticky side 307 of a thin film 330 of a thermoplastic tape is applied to the bottom surface 311 of a lens button 310. The button-tape assembly is centered on the front surface 322 of the flange 302 by a tool 340 having a cup 342 which engages the button 310. The assembly is heated by a heat source such as a lamp 313 to a temperature sufficient to soften the film 330 of adhesive while applying force from rod 315 to the button 310, suitably 3 pounds of force at a temperature of 130° F. for 30 seconds.

Figure 6:
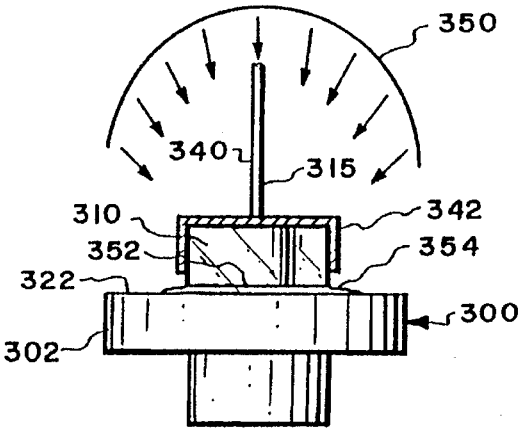
FIG. 6 is a schematic view of the use of a thin film of wax to adhere a lens blank to a block.

Referring now to FIG. 6, instead of a disc of adhesive, a thin film of lens wax is used. The block 300 is preheated to a temperature of about 125° F. from a heat source 350. A film 352 of conventional water soluble wax is applied to the central portion of the surface of the blocking member 300. The lens blank 310 is centered on the front surface 322 of the flange and pressure, usually 10 pounds for about 2 minutes is applied from rod 315 to the cup 342 holding the lens blank 310. Excess wax 354 exudes from under the lens blank 200 onto the surface 322 of the flange 302. The heat source 350 is turned off and the force is terminated after a few minutes. Surprisingly, a thin film of wax adhesive is formed that is stronger than thicker films.

Figure 7:
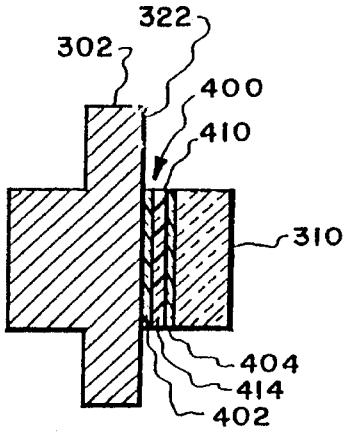
FIG. 7 is a side view of a lens blank adhered to the block of FIG. 3 with a double layered adhesive.

As shown in FIG. 7, the heating step can be eliminated by using a disc 400 of double sided adhesive tape. The tape 410 has a substrate 414 containing a top layer 402 and a bottom layer 404 of pressure sensitive adhesive. The disc 400 is adhered first to the lens button 310 and then the lens button is applied to the center of the front surface 322 of the flange 302 by tooling, not shown.

Figure 8:
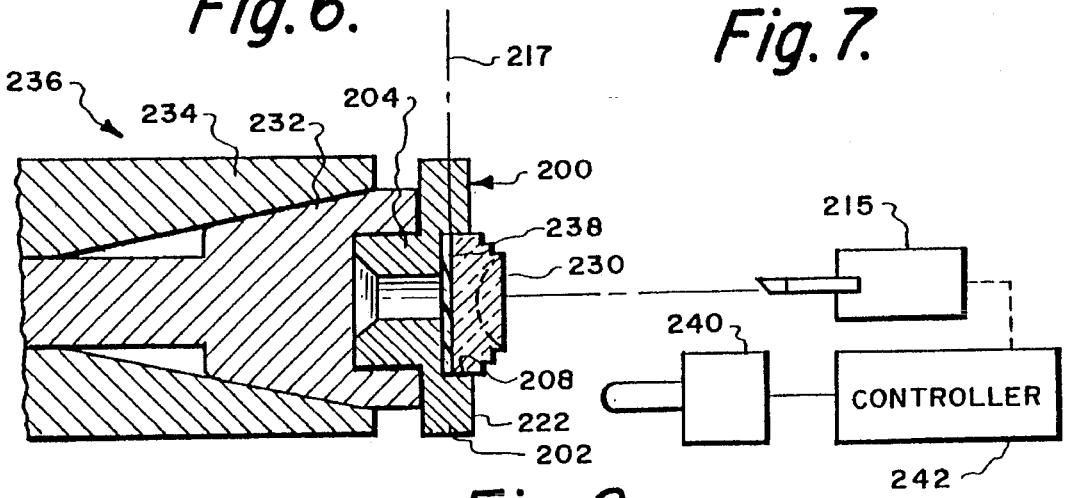
FIG. 8 is a view in section of a cutting system for base curves providing constant center thickness after probing.

Referring now to FIG. 8, a lens button 230 is shown mounted in the recess 208 of the base curve block 200. The shank 204 of the block 200 is held by a drawback collet 232 in the nose 234 of a lathe spindle 236. The lens blank is held in the recess 208 by a film 238 of wax adhesive. By probing the position of outer, front surface 222 of the flange 202 with a probe 240 to develop a position signal. Controller 242 can be programmed to control tool 215 to cut a base curve with a known dimension relative to the reference surface 217. The standard drawback collet 232 requires probing the front surface 222 of the flange 202 of the block each time a new block with lens blank is inserted into the collet 232 in the spindle 234.

Figure 9:
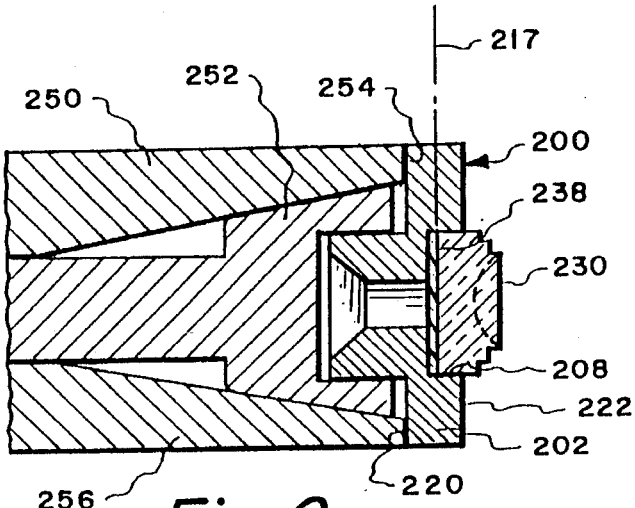
FIG. 9 is a view in section showing a dead length base curve cutting system for constant center thickness.

FIG. 9 illustrates the base curve block 200 held in a spindle 250 with a recessed collet 252. Since the rear face 220 of the block 200 always abuts the front face 254 of the nose 256 of the spindle 250, the location of the reference surface 217 relative to the spindle is always the same. A single probe of the front surface 222 of the flange 202 is all that is required for a run of base curve turning assuming the blocks are all identical. The cutting of the front surface can proceed without measuring the center thickness of the lens blanks.

Figure 10:
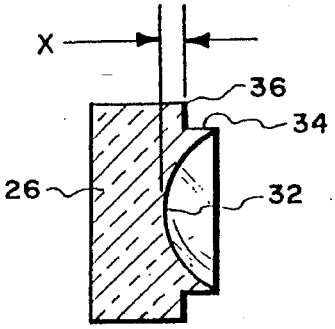
FIG. 10 is a side view of the lens blank with base curve and reference surface.

Referring now to FIG. 10, since the base curve 32 and reference surfaces 34, 36 are formed in the lens blank 26 during the same manufacturing stage, under a common computer control, and without adjusting the position of the lens blank 26, the relative positions of these surfaces can be very accurately controlled. The two dimensional factors that are used to automatically align the lens blank during subsequent formation of the outer lens curve are the distance X between the maximum depth of the base curve 32 and the top of the surrounding ledge 36.

The invention as described above thus offers a greater degree of control and quality in the manufacture of contact lenses, together with a reduction in the number of manufacturing steps and the accompanying opportunities for error. While specific embodiments have been described, numerous variations and alternate embodiments will occur to those skilled in the art. For example, while radial and axial reference surfaces are preferred for the lens blank, these surfaces could be formed at other angles, so long as corresponding adjustments are made to the blocking member. Accordingly, it is intended that the invention be limited only in terms of the appended claims.

I claim:

1. A blocking member to be engaged by the nose extension of a spindle of a lathe containing a recessed collet for carrying a lens blank in which a base curve is to be formed, said lens blank having a flat rear surface, said blocking member comprising:

a flange having a diameter larger than the diameter of the collet so as to be able to seat on the forward end of the spindle nose extension, said flange having a forward surface and a rearward surface;

a collet engaging shank extending rearward from said flange;

a lens blank receiving region formed in the central portion of said forward surface for receiving said flat rear surface of the blank; and a reference surface normal to the central axis of the flange for locating the rear surface of the lens blank.

2. A blocking member according to claim 1 in which the flange is cylindrical.

3. A blocking member according to claim 2 in which the forward surface of the flange is recessed to form a lens blank engaging cavity.

4. A blocking member according to claim 3 in which the inner surface of the cavity is partially recessed to form wax receiving areas.

5. A blocking member according to claim 2 in which the reference surface is on the forward surface of the flange.

6. A blocking member according to claim 2 in which the lens blank receiving region is parallel to the reference surface.

7. A blocking member according to claim 2 in which the forward surface of the flange is flat and is perpendicular to the axis of the flange and forms said flat, lens blank receiving region.

8. A blocking member according to claim 1 formed of metal.

9. A blocking member according to claim 8 in which the shank is hollow.

10. A method of forming a posterior curve in a lens blank having a flat rear surface;

adhering the flat rear surface of the blank to the center of the front surface of a flange of a first lens blocking member with a film of solid adhesive tape, said flange having a diameter larger than said blank and larger than the spindle of a lathe and said member having a rearwardly extending shank;

inserting the shank into the spindle of said lathe; and turning said spindle relative to a cutting tool to form said posterior curve in the front surface of the lens blank.

11. A method according to claim 10 in which the film of adhesive is selected from thermoplastic adhesive tapes, double sided adhesive tapes and films of wax.

12. A method according to claim 11 in which an assembly of the lens blank, thermoplastic adhesive film or wax film and blocking member is placed under pressure and the assembly is heated for a time sufficient to render the adhesive tacky.

13. A method according to claim 12 in which the film is a wax film and the assembly is placed under a uniform pressure of 5–20 pounds sufficient to expel most of the film of wax from under the lens blank to form a thin film of wax and cooling the thin film to firmly adhere the lens blank to the front surface of the flange.

14. A method according to claim 10 in which a reference ledge is formed in the front surface of the lens blank.

15. A method according to claim 14 further comprising the steps of:

adhering the posterior curve and reference ledge to a surface of a second block having a complementary surface;

placing the shank of the second block in the spindle of a lathe; and turning the spindle relative to a cutting tool to form a front surface curve on said lens blank.

16. A method according to claim 15 in which the second block contains a central flange having a diameter larger than the collet of the lathe.

17. A method according to claim 16 in which the rearward surfaces of the first and second lens blocking members are placed in engagement with the front nose of the spindle during said turning steps.

18. A lens forming system for forming contact lenses or intraocular lenses from a lens blank comprising in combination:

a spindle having a bore mounted at its forward end;

a first blocking member having a flange having rearward facing surface a forward facing flat surface larger than said lens blank and a shank extending from the rearward surface to be received in said collet;

a means for adhering the inner surface of a lens blank to the center of the flat surface;

a means for rotating said spindle relative to a cutting tool for forming a base curve and a flat annular reference surface at a known location in the lens blank relative to said inner surface of the lens blank;

a second blocking member having a first surface complementary to said base curve for engaging the base curve of the lens blank and having a flat annular reference surface complementary to and abutting the annular reference surface and having a rearward directed shank for receipt in the bore of the spindle having a central flange having a diameter larger than said spindle collet and having a forward directed surface and a rearward directed surface; and means for rotating the spindle relative to a cutting tool to shape the outer surface of the lens blank to form the outer curved surface of a lens.

19. A lens forming system according to claim 18 in which the rearward surfaces of the flanges of the blocking members abut the front end of the spindle.

20. A lens forming system according to claim 18 in which both blocking members comprise metal or plastic.

* * * * *